US005265730A

United States Patent [19]

Norris et al.

[11] Patent Number: 5,265,730

[45] Date of Patent: Nov. 30, 1993

[54] VIBRATORY SCREEN SEPARATOR

[75] Inventors: Timothy L. Norris, Glasgow; Scott R. Patterson, Nicholasville, both of Ky.; Daniel J. Lantz, Centerville, Ohio

[73] Assignee: Sweco, Incorporated, Florence, Ky.

[21] Appl. No.: 864,401

[22] Filed: Apr. 6, 1992

[51] Int. Cl.[5] ..... B07B 1/34

[52] U.S. Cl. ..... 209/326; 209/366.5; 198/770

[58] Field of Search ..... 209/325, 326, 366.5, 209/405, 367, 412; 198/761, 770

[56] References Cited

U.S. PATENT DOCUMENTS

| | | | |
|---|---|---|---|
| 3,762,547 | 10/1973 | Stirk | 209/326 |
| 4,274,953 | 6/1981 | Jackson | 209/326 |
| 4,582,597 | 4/1986 | Huber | 204/313 |
| 5,051,171 | 9/1991 | Hukki | 209/323 |

FOREIGN PATENT DOCUMENTS

| | | | |
|---|---|---|---|
| 865420 | 9/1981 | U.S.S.R. | 209/325 |

OTHER PUBLICATIONS

Drawing illustrating known vibratory motion generation systems.

DF Corporation brochure, undated, entitled "first in a Series of Illustrations Showing Applications of Vimarc Shaker Motors in Diverse Industries and For Many Purposes".

DF Corporation brochure, undated, entitled "Second in a Series of Illustrations Showing Applications of Vimarc Shaker Motors in Diverse Industries and For Many Purposes".

Cleveland Vibratory Company brochure entitled "Rotary Electric Vibrators", Bulletin RE-85.

*Primary Examiner*—Robert P. Olszewski
*Assistant Examiner*—Kenneth Noland
*Attorney, Agent, or Firm*—Lyon & Lyon

[57] ABSTRACT

A vibratory screen separator having a base, resilient mountings and a separator frame. Screens are fixed in the separator frame. Rotary eccentric vibrators are positioned on each side of the frame at the center of mass and inclined both in the direction of motion of the material and tilted normal to the direction of motion of the material in opposite directions to define uni-directional elliptical vibratory motion in the frame.

13 Claims, 3 Drawing Sheets

VIBRATORY SCREEN SEPARATOR

BACKGROUND OF THE INVENTION

The field of the present invention is screen separators using vibratory motion to enhance separation.

Separation, sifting and the like through screens have long been accomplished with the assistance of vibratory motion. Such motion has been used as a means for vibrating the screens through which material is to pass, thereby using inertia and particle interaction of the material itself in assisting it through the screen, reducing screen blinding effects and physically breaking up clumps of material to improve screening efficiency. Such vibration also can be used as a means for advancing material along a surface. In screening, advancement and screening are both enhanced by vibratory motion. One such screening device is disclosed in U.S. Pat. No. 4,582,597, the disclosure of which is incorporated herein by reference. Also in screening, vibratory motion can be used to cause impacts by the screen with solid elements positioned adjacent the screen for additional cleaning effects. Reference may be made to U.S. Pat. No. 5,051,171, the disclosure of which is incorporated herein by reference.

A plurality of motions have been commonly used for the screening of materials. Round motion may be generated by a simple eccentric located roughly at the center of gravity of a resiliently mounted screening device. Such motion is considered to be excellent for particle separation and excellent for screen life. It requires a very simple mechanism, a single driven eccentric weight. However, round motion acts as a very poor conveyor of material and becomes disadvantageous in continuous feed systems where the oversized material is to be continuously removed from the screen surface. Another common motion is achieved through the counter rotation of adjacent eccentric vibrators also affixed to a resiliently mounted screening structure. Through the orientation of the eccentric vibrators at an angle to the screening plane, linear vibration may be achieved at an angle to the screen plane. Such inclined linear motion has been found to be excellent for purposes of conveying material across the screen surface. However, it has been found to be relatively poor for purposes of separation and is very hard on the screens.

Another motion commonly known is multi-direction elliptical motion wherein the single rotary eccentric vibrator is located at a distance from the center of gravity of the screening device. This generates elliptical motions in the screening device. However, the elliptical motion of any element of the screen has a long axis passing through the axis of the rotary eccentric vibrator. Thus, the motion varies across the screening plane in terms of direction. This motion has been found to produce efficient separation with good screen life. As only one eccentric is employed, the motion is simple to generate. However, such motion is very poor as a conveyor.

In reviewing the motions typically associated with rectangular screening devices, compromises are inevitable. One typically must choose among strengths and weaknesses in conveying capability, screening capability and screen life.

SUMMARY OF THE INVENTION

The present invention is directed to uni-directional elliptical motion generation in vibratory screen separators. Such motion acts as a good conveyor, it is good for screen life and it provides good separation.

In achieving the foregoing motion, two rotary eccentric vibrators may be arranged on a screening structure with the axes of the vibrators inclined from the vertical to a similar degree away from the intended direction of travel of material to be conveyed across the screening surface and inclined from the vertical oppositely in a plane perpendicular to the intended direction of travel of the material. The inclination of the large axis of the elliptical motion relative to the screen surface is controlled by the inclination of the rotary eccentric vibrators away from the intended direction of travel of the material on the screen surface. The inclination of the vibrators in a plane perpendicular to the intended direction of material travel varies the width of the ellipse.

Accordingly, it is an object of the present invention to provide an improved vibratory screening system having uni-directional elliptical motion. Other and further objects and advantages will appear hereinafter.

DETAIL DESCRIPTION OF THE PREFERRED EMBODIMENT

Figure 1:
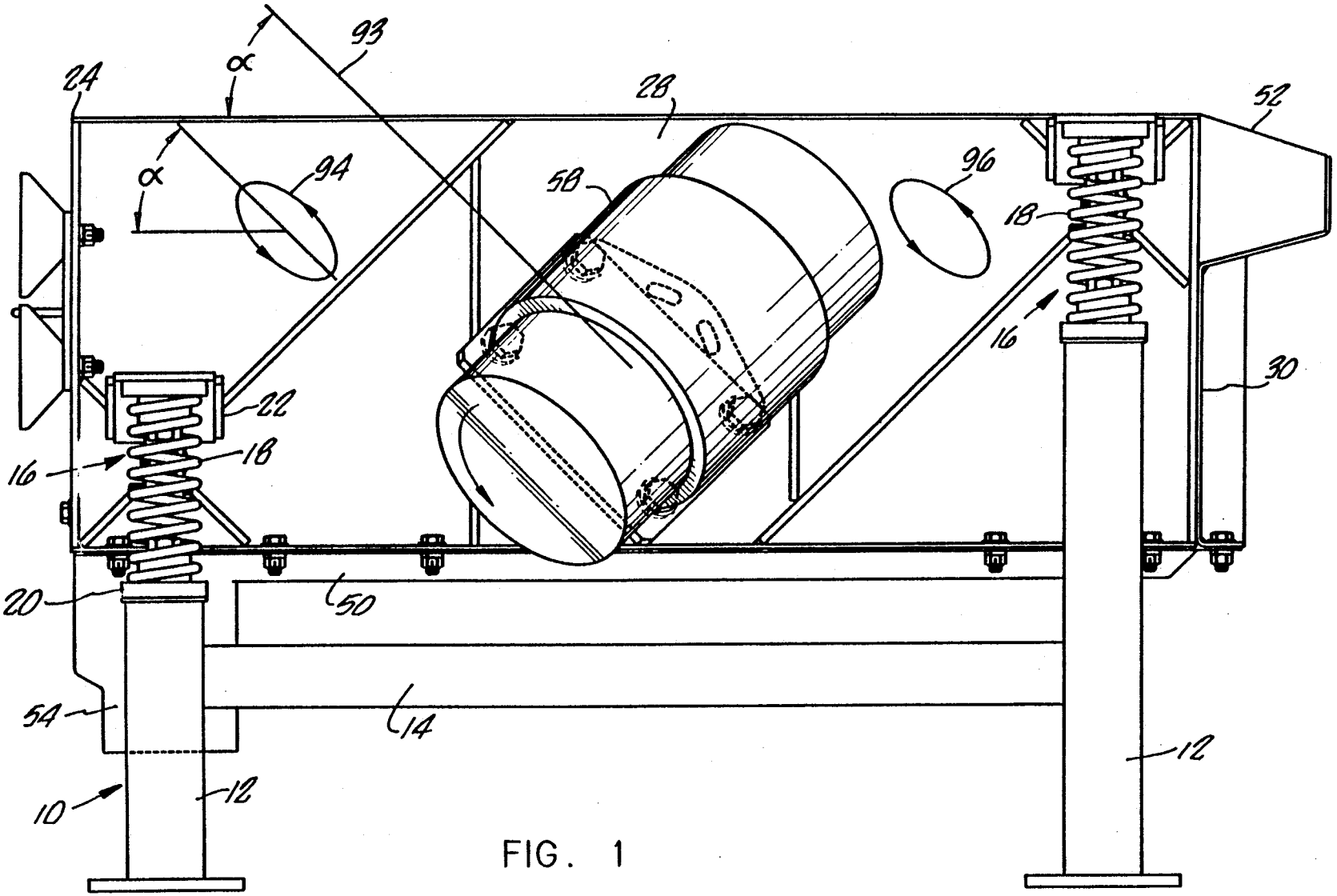
FIG. 1 is a side view of a vibratory screen separator having uni-directional elliptical motion.
Figure 2:
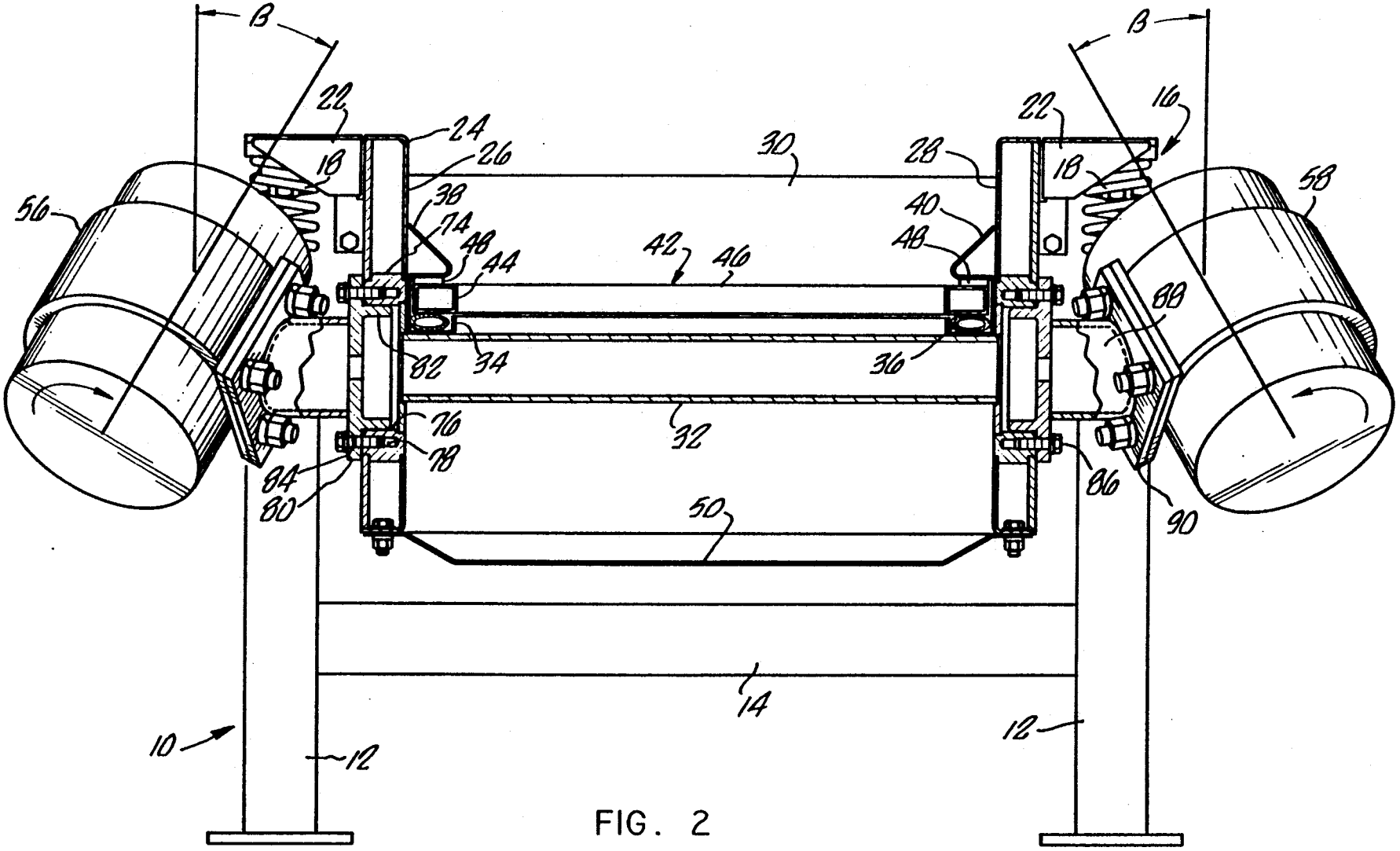
FIG. 2 is a cross-sectional end view taken through the vibrator mountings.

Turning in detail to the drawings, FIGS. 1 and 2 illustrate a vibratory screen separator. The separator includes a base 10 having four legs 12 and supporting members 14. Mounted on the four legs 12 are resilient mounts 16. Each mount 16 includes a spring 18, a base 20 on each leg 12 and a socket 22 on the separator to receive each spring 18. Positioned on the base 10 by the resilient mounts 16 is a separator frame 24. The separator frame 24 includes sidewalls 26 and 28 and a back wall 30. The front side, opposite to the back wall 30, may be left open. The frame 24 is of sufficient structure to withstand the vibrational loads imposed on the frame 24 in operation. Extending across the interior of the frame 24 between the sidewalls 26 and 28 is a structural tube 32 at roughly the center of mass for further structural strength.

Located about the sidewalls 26 and 28 and the back wall 30 is a channel 34. The channel 34 is upwardly open and receives an inflatable member or members 36 in the form of a tube. Located above the channel 34 on the sidewalls 26 and 28 are stops 38 and 40. The stops cooperate with the channel 34 through its extent along the sidewalls 26 and 28 to form a screen mounting in a first plane. A screen 42 having a screen frame 44 and screen cloth 46 is illustrated positioned in the screen mounting. Resilient members 48 are positioned on the underside of the stops 38 and 40 to help locate, seat and seal the screen frame 44. Once the screen 42 is positioned, the inflatable member 36 may be pressurized to force the screen frame 44 upwardly against the resilient members 48. In this manner, the screen 42 is securely retained in position. Obviously, multiple screens 42 may be employed in any one separator.

A pan 50 is located below the screen mounting to receive material passed through the screen 42. An inlet 52 is positioned at the back wall 30 above the screen mounting. An outlet 54 for material passed through the screen 42 receives material from the pan 50 for discharge. Material not passing through the screen 42 is discharged off the end of the screen 42 and suitably collected. The flow across the screen plane from the inlet 52 toward the outlet 54 defines a linear direction of material travel.

Figure 3:
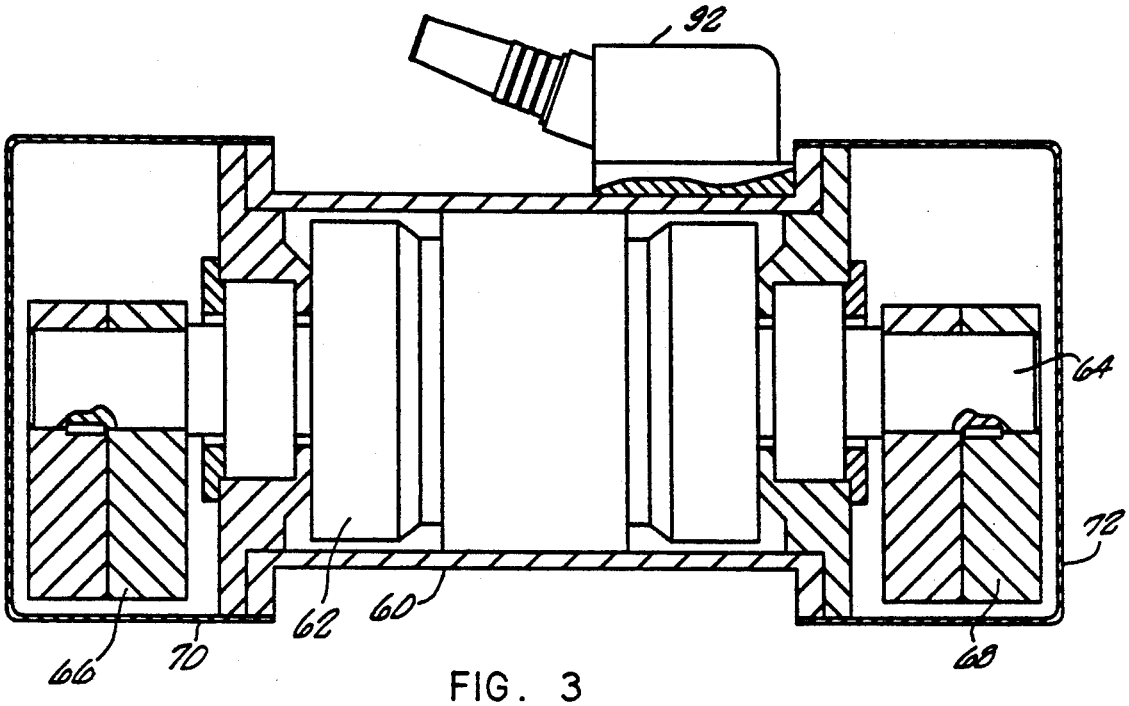
FIG. 3 is a central cross section of a typical rotary eccentric vibrator.

Attached to the sides of the frame 24 and specifically to each sidewall 26 and 28 are two rotary eccentric vibrators 56 and 58. The internal structure of a typical such vibrator is illustrated in FIG. 3. A central housing 60 mounts a motor 62 and a rotatably mounted shaft 64. The shaft serves as the armature of the motor and extends outwardly thereof to mount eccentric weights 66 and 68. The weights are shown to be in covers 70 and 72. Thus, the shaft 64 forms an axis of rotation for the vibrator.

Figure 4:
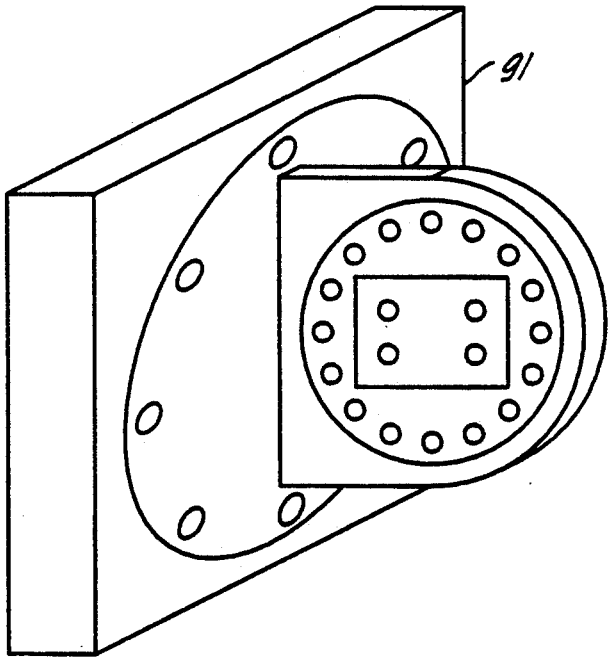
FIG. 4 is an alternate fixture for mounting a rotary eccentric vibrator.

FIGS. 1 and 2 illustrate a first mounting system for each of the rotary eccentric vibrators 56 and 58. A socket 74 is rigidly fixed in each of the sidewalls 26 and 28 aligned with the structural tube 32. The socket includes a central circular mounting hole 76 and fastener holes 78 arranged in a periphery about the mounting hole 76. A mounting bracket 80 includes a cylinder 82 which closely fits within the mounting hole 76. Through holes 84 are positioned about the cylinder 82 in a similar manner to the fastener holes 78. The mounting bracket 80 may be rotated as desired and fixed in position by fasteners 86 extending through the through holes 84 to the fastening holes 78. A post 88 is coupled with this base of the mounting bracket 80 and extends to a mounting plate 90 arranged at an angle to the post 88. The mounting plate 90 also includes mounting holes for receipt of one of the rotary eccentric vibrators 56 and 58. A second embodiment is schematically illustrated in FIG. 4 where perpendicular degrees of freedom provide a universal mounting 91 for a wide range of orientations for the mounted vibrator.

The orientations of the mounted rotary eccentric vibrators 56 and 58 provide a uni-directional elliptical motion. Each of the vibrators 56 and 58 is illustrated in the preferred embodiment as being mounted laterally to either side of the center of mass of the resiliently mounted frame 24. The two vibrators 56 and 58 are counter-rotating and equal in eccentricity. They are synchronized naturally by dynamic interaction between the two. If further synchronizing is required, reluctance motors 62 wired in parallel may be employed. Alternatively, sensors and controlling units 92 may be employed to achieve synchronization.

The slope of a line 93 perpendicular to the axis of rotation of the vibrator and located in a vertical plane, designated as $\alpha$, represents the slope of the desired elliptical motion. The elliptical motion desired is illustrated by arrows 94 and 96. The slope of the elliptical motion provides both screening function and advancement function to the material on the screen 42.

Looking to FIG. 2, the vibrators 56 and 58 are inclined away from the vertical in opposite directions as measured in a vertical plane normal to the linear direction of material travel on the screen plane by an angle $\beta$. Adjusting the tilt slope $\beta$ affects the motion of the frame 24 to generate elliptical motion. If $\beta$ equals zero, the vibration produced will be straight line motion having a slope equal to $\alpha$. As the vibrators are inclined away from or toward one another, the broader the ellipse will become. If $\beta$ approaches 90°, the screen deck motion approaches circular. Thus, by having the axes of rotation of the vibrators 56 and 58 inclined in the direction of travel ($\alpha$) material will be screened and advanced on the screen 42. By oppositely inclining the vibrators 56 and 58 in a direction normal to the direction of travel ($\beta$) the motion becomes elliptical and exhibits excellent separating properties. In the preferred embodiment, an $\alpha$ of 45° and a $\beta$ of 30° have been used. Actual settings may be based on empirical studies for any given material. By reducing $\beta$, the conveying force is increased but screening efficiency decreases and vice versa. It is anticipated that $\beta$ may be most advantageously maintained between 30° and 40° with a possible range of 20° to 45°.

With the ellipse having a relatively longer major axis to minor axis, good conveying properties are achieved. As the motion does not vary from place to place on the screen, uniform conveying is achieved. This motion also contributes to screen longevity. Unlike linear motion which comes to a full stop at each end of the stroke, elliptical motion is continuous. This greatly reduces hard impact by the material against the screen cloth. This motion also contributes to good separation. The elliptical motion has a tendency to tumble material on the screen surface to enhance screening. Thus, good material conveyance and particle separation are achieved through uni-directional elliptical vibration.

Thus, an improved separating system has been disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A vibratory screen separator comprising a frame having a screen mounting extending in a first plane and defining a linear direction of material travel in said first plane; and first and second rotary eccentric vibrators having first and second axes of rotation, respectively, said first and second vibrators being mounted to said frame and mutually spaced in a direction lateral to said linear direction of material travel, said axes being inclined from vertical similarly away from said direction of travel and oppositely in a plane perpendicular to said direction of travel.

2. The vibratory screen separator of claim 1 wherein said first and second rotary eccentric vibrators have equal eccentricity.

3. The vibratory screen separator of claim 1 wherein said first and second rotary eccentric vibrators are mounted to either side of said screen mounting.

4. The vibratory screen separator of claim 1 wherein said first and second rotary eccentric vibrators each include a mount, a shaft rotatably mounted in said mount and two eccentric weights fixed to and mutually spaced along said shaft to either side of said mount.

5. The vibratory screen separator of claim 4 wherein said first and second rotary eccentric vibrators each further include a motor coupled with each said shaft, respectively.

6. The vibratory screen separator of claim 1 wherein said first and second rotary eccentric vibrators each include a mount for mounting said rotary eccentric vibrator to said frame, said mount being adjustable to adjust the inclination of said rotary eccentric vibrator away from said direction of travel.

7. The vibratory screen separator of claim 1 wherein said first and second rotary eccentric vibrators each include a mount for mounting said rotary eccentric vibrator to said frame, said mount being adjustable to adjust the inclination of said rotary eccentric vibrator in a plane perpendicular to said direction of travel.

8. The vibratory screen separator of claim 1 wherein said first and second rotary eccentric vibrators rotate in opposite directions.

9. The vibratory screen separator of claim 1 wherein the rotations of said first and second rotary eccentric vibrators are synchronized.

10. A vibratory screen separator comprising a frame having a screen mounting extending in a first plane and defining a linear direction of material travel in said first plane; and first and second rotary eccentric vibrators being mounted to said frame on either side of said screen mounting in a direction lateral to said linear direction of material travel, being of equal eccentricity, rotating in opposite directions, and having first and second axes of rotation, respectively, which are inclined from vertical similarly in said direction of travel and oppositely in a plane perpendicular to said direction of travel.

11. The vibratory screen separator of claim 10 wherein said first and second rotary eccentric vibrators each include a mount, a shaft rotatably mounted in said mount and two eccentric weights fixed to and mutually spaced along said shaft to either side of said mount.

12. The vibratory screen separator of claim 11 wherein said first and second rotary eccentric vibrators each further include a motor coupled with each said shaft, respectively.

13. A vibratory screen separator comprising a base;

a resilient mounting on said base;

a frame mounted to said base by said resilient mounting and having a screen mounting extending in a first plane and defining a linear direction of material travel in said first plane;

a screen fixed in said screen mounting; and first and second rotary eccentric vibrators being mounted to said frame on either side of said screen mounting in a direction lateral to said linear direction of material travel, being of equal eccentricity, rotating in opposite directions, and having first and second axes of rotation, respectively, which are inclined from vertical similarly away from said direction of travel and oppositely in a plane perpendicular to said direction of travel.

* * * * *